US007282135B1

(12) United States Patent
Kiser et al.

(10) Patent No.: US 7,282,135 B1
(45) Date of Patent: Oct. 16, 2007

(54) LOW VISCOSITY, HIGH CARBON YIELD PITCH PRODUCT

(75) Inventors: Melvin D. Kiser, Huntington, WV (US); David C. Boyer, Huntington, WV (US)

(73) Assignee: Marathon Ashland Petroleum Co., LLC, Findlay, OH (US)

( * ) Notice: Subject to any disclaimer, the term of this patent is extended or adjusted under 35 U.S.C. 154(b) by 602 days.

(21) Appl. No.: 10/981,249

(22) Filed: Nov. 3, 2004

Related U.S. Application Data

(62) Division of application No. 10/409,658, filed on Apr. 7, 2003, now Pat. No. 6,827,841.

(51) Int. Cl.
*C10G 1/16* (2006.01)
*C10G 3/16* (2006.01)

(52) U.S. Cl. ..... 208/44; 208/23; 208/22

(58) Field of Classification Search ..... 208/44
See application file for complete search history.

(56) References Cited

U.S. PATENT DOCUMENTS

| | | | |
|---|---|---|---|
| 4,151,003 | A | 4/1979 | Smith et al. |
| 5,096,566 | A | 3/1992 | Dawson et al. |
| 5,746,906 | A | 5/1998 | McHenry et al. |
| 6,015,440 | A | 1/2000 | Noureddini |
| 6,174,501 | B1 | 1/2001 | Noureddini |
| 6,203,585 | B1 | 3/2001 | Majerczak |
| 6,235,104 | B1 | 5/2001 | Chattopadhyay et al. |
| 6,348,074 | B2 | 2/2002 | Wenzel |
| 6,399,800 | B1 | 6/2002 | Haas et al. |

*Primary Examiner*—Tam M. Nguyen
(74) *Attorney, Agent, or Firm*—Emch, Schaffer, Schaub & Porcello, Co., L.P.A.

(57) ABSTRACT

A low viscosity, high coking value petroleum tar material having a high coking value as compared to standard petroleum tars and containing at least one biodiesel material dissolved therein, and a method for producing such material, are disclosed.

12 Claims, No Drawings

LOW VISCOSITY, HIGH CARBON YIELD PITCH PRODUCT

CROSS REFERENCE TO RELATED APPLICATION

This patent application is a divisional of patent application Ser. No. 10/409,658 filed Apr. 7, 2003 now U.S. Pat. No. 6,827,841.

FIELD OF THE INVENTION

The present invention relates to a low viscosity, high carbon yield pitch product made from pitch and biodiesel materials such as fatty acid esters.

BACKGROUND OF THE INVENTION

Petroleum pitch competes with coal tar pitch in many applications where the pitch is used as a carbon source and/or as a binder material. The critical properties that are evaluated when deciding what type of pitch to use include: (a) flow properties, as measured by softening point and/or viscosity, and (b) carbon yield, as measured by ASTM D 2416, Coking Value by Modified Conradson Carbon.

Historically, low viscosity products derived from coal tar have been used in the production of products for the refractory industry. These coal tar-derived products offer a source of carbon with low viscosity. The coking value of these coal tar-derived products (as measured by ASTM D 2416, Coking Value by Modified Conradson Carbon) is approximately 28 to 29 wt. %. One drawback, however, is that the coal tar derived materials have a relatively high level of regulated polynuclear aromatic hydrocarbons.

Therefore, another pitch property that is also becoming of increasing interest is the polynuclear aromatic hydrocarbon (PAH) content. The McHenry et al. U.S. Pat. No. 5,746,906 describes a coal tar pitch having a low PAH content and a method of making such pitch where a high softening point coal tar pitch (softening point of 120-175° C.) was mixed with a low softening point petroleum pitch to make a binder pitch having a softening point of 107-114° C. and a PAH content slightly above 15,000 ppm.

For example, in the manufacture of coal tar pitch, if more low boiling point materials are left in the pitch product, the resulting product has a lower softening point and a lower viscosity. In the case of petroleum pitch manufacturing, a high softening point petroleum pitch can be "cutback" with a hydrocarbon liquid material to produce a petroleum pitch having a lower softening point and a lower viscosity at a given temperature. Generally speaking, for a given softening point and given viscosity, a petroleum pitch will have a lower carbon yield than a coal tar pitch. However, despite a potentially lower carbon yield, petroleum pitch offers certain advantages over coal tar pitch. One such commercial example is a specialty pitch blend produced by Marathon Ashland Petroleum LLC known as A-500 pitch which is used by the refractory industry. This product offers a significant reduction in the amount of polycyclic aromatic hydrocarbons present as compared to coal derived tars.

In the past, many types of materials have been used to modify the flow properties of such petroleum products as pitch and asphalt. Historically, these have been petroleum based, non-oxygenated hydrocarbons such as diesel fuel or various types of fuel oils, kerosene or various cutback oils. However, the use of these solvent "cutback" materials often causes safety problems with flash point and a volatility if too much solvent is used.

Examples of viscosity modification of bituminous materials include the use of a floruoro or chlofloruoro derivative of lower alkanes, such as disclosed in Smith et al., U.S. Pat. No. 4,151,003.

Other methods include reducing the viscosity of heavy hydrocarbon oils by preheating a stream of heavy carbon hydrocarbon oil in a stream of gas, mixing under pressure, and passing the pressurized mixture through a nozzle to form fine oil droplets such that a strong shearing action is created as the heavy oil and gas are forced through an orifice, as described in Dawson et al. U.S. Pat. No. 5,096,566.

Therefore, there still is a need, however, to produce a viscosity modifier that is useful with petroleum pitches, but does not have the above described drawbacks associated with the viscosity modifiers currently in use.

In particular, there is a need for a viscosity modifier that provides improved characteristics to the pitch itself and to the pitch end product.

There is a further need for a viscosity modifier useful with pitch blends that provides improved safety features such as low volatility and low toxicity.

There is also a need to provide a replacement for coal tar-derived materials that still meet the industries' needs for a high carbon yield (i.e. high coking value) product.

Recently, the use of biodiesels, such as methyl esters of fatty acids derived from either soybean or animal fats have received some attention to augment diesel fuel supplies in the United States. Until the present invention, however, no one had thought to use oxygenated compounds, and in particular, biodiesels, both as a viscosity reduction agent and as a high carbon yield agent for pitches, and, in particular, for petroleum pitches.

SUMMARY OF THE INVENTION

In one aspect, the present invention relates to a low viscosity, high coking value petroleum tar material comprising, at least one petroleum pitch starting material having a high coking value and high viscosity, and at least one biodiesel material dissolved in the petroleum pitch starting material. In certain embodiments, the petroleum pitch starting material has a coking value of about 35 wt % or greater. Also, in certain aspects, about 20 to about 45 wt % of the at least one biodiesel is dissolved in the petroleum pitch starting material and in other aspects, about 35 to about 50 wt % of at the least one biodiesel is dissolved in the petroleum pitch starting material.

In other aspects, the petroleum pitch starting material can comprise petroleum pitch and a typical petroleum based cutback oil. Properties of this type of typical cutback oil include with those a maximum API Gravity of 20° API. These typical cutback oils may include various types of aromatic and non-aromatic oils such as those derived from lube plant operations, distillation operations, thermal cracking operations and catalytic cracking operations.

In certain aspects, the petroleum pitch starting material comprises about 35%, by wt., petroleum pitch and about 65%, by wt., #6 fuel oil. According to certain aspects, the biodiesel material used in the low viscosity, high coking value petroleum tar material of the present invention comprises at least one oxygenate compound. In certain embodiments, the biodiesel material comprises at least one type of ester derived from vegetable oil and/or animal fats. In other aspects, the biodiesel material comprises at least one type of suitable fatty acid ester, and in still other aspects, the biodiesel material comprises at least one type of suitable fatty acid methyl ester.

The present invention also relates, in part, to a method of maintaining a desired viscosity with reduced impact on the coking value of a resulting petroleum tar dissolving at least one petroleum pitch starting material into at least one biodiesel material. In certain aspects, the petroleum pitch starting material has a coking value of about 35 wt % or greater. The at least one petroleum pitch starting material can be substantially molten, and/or substantially solid.

DETAILED DESCRIPTION OF THE PREFERRED EMBODIMENTS

In one aspect, the present invention relates to a method of producing a petroleum tar of desired viscosity by formulating a petroleum pitch with a cutback material comprising methyl esters of fatty acids, such as biodiesel. The resulting petroleum tar has a higher carbon yield as compared with formulations having similar flow properties that have been produced from petroleum pitch and conventional cutback oils.

In certain aspects of the present invention, the petroleum pitch product and biodiesel are mixed together. In one formulation, solid petroleum pitch is dissolved into the biodiesel material. Alternately, in another formulation, the petroleum pitch is heated to produce a molten material and a suitable amount of at least one biodiesel material is dissolved in the molten material.

In certain embodiments, the desired petroleum tar is produced by formulating a petroleum pitch with a biodiesel material to desired viscosity specifications. The exact amount of biodiesel material is adjusted to meet the customer's desired flow properties. One such example of suitable flow properties is a viscosity in the range of 230 to 300 centipoise at 160° F. One type of petroleum pitch product found acceptable as a starting material has the following specifications: a Mettler softening point (ASTM D 3104) ranging from about 118 to about 124° C.; a minimum Cleveland Open Cup flash point (ASTM D 92) of about 270° C.; a minimum coking value as measured by the modified Conradson method (ASTM D 2416 of about 49 wt %; a maximum sulfur content (ASTM D 1552) of about 3.0 wt %; and, a minimum density as measured with a helium gas comparator pycnometer (ASTM D 604) of about 122. One embodiment contains from about 10 to about 50%, by weight, of the biodiesel is dissolved in the petroleum pitch product. The exact amount of biodiesel added is dependent on the desired viscosity range of the final product.

According to certain aspects of the present invention, the biodiesel material comprises at least one oxygenate compound such as esters derived from vegetable oils and/or animal fats. In certain embodiments, the biodiesel material comprises suitable fatty acid methyl esters.

One aspect of the present invention is a petroleum/tar material that has a relatively higher coking value as compared to other petroleum tars with similar flow properties (viscosity). The coking value (as measured by ASTM D 2416) of a typical petroleum tar with a viscosity between about 230 and 300 centipoise at 160° F. is normally approximately 19 to 20 wt. %. The petroleum tar material of the present invention has a coking value greater than about 30 wt. %, which is about a 50% increase over the currently available materials. The coking value of the petroleum/tar material of the present invention meets or exceeds commercial coal tar pitch products for the same application.

Another aspect of the present invention includes the use of at least one petroleum pitch, at least one methyl ester (including, for example, methyl esters of fatty acids such as biodiesel, and, optionally at least one other non-oxygenated hydrocarbon to form low viscosity, high carbon yield petroleum tar products. One example of a low viscosity, high carbon yield petroleum tar product formulation includes petroleum pitch, biodiesel, and at least one non-oxygenated hydrocarbon, including, but not limited to, #6 fuel oil and aromatic extracts from lube oil processing.

One advantage of the present invention is that the polycyclic aromatic hydrocarbon content of the low viscosity, high carbon yield petroleum tar product is significantly lower than current petroleum tar products, and many times lower than typical coal tar products.

A comparison of the properties of a commercially available coal tar and petroleum tar currently in use and the properties of one of the embodiments of this invention may be found in Table I below.

TABLE I

Comparison of Properties of Tars

| Analysis | | Test Method | Coal Derived Tar | A-500 Petroleum Tar | Ex. 1 |
|---|---|---|---|---|---|
| Coking Value, modified Conradson Carbon wt% | | ASTM D 2416 | 28 | 19 | 31.6 |
| Viscosity, absolute, at 160° F., centipoise | Minimum | ASTM D 4402 | 230 | 230 | 246 |
| | Maximum | | 300 | 300 | |
| Detected Polycyclic Aromatic Hydrocarbons, wt ppm** | | GC/ Mass Spectroscopy | 149,000 | 21,000 | 4,500 |

*Commercially available from Marathon Ashland Petroleum LLC
**Includes all detected polycyclic aromatic compounds Another advantage is that the use of biodiesel as a cutback material is more cost effective than cutback oils such as dibasic ester based materials.

Another aspect of the present invention includes the use of coal tar pitch, biodiesel, and other non-oxygenated hydrocarbons to form low viscosity, high carbon yield coal tar products. The low viscosity, high carbon yield coal tar product formulations include coal tar, coal tar pitch, biodiesel, and non-oxygenated hydrocarbons, including, for example, but not limited to, #6 fuel oil and aromatic extracts from lube oil processing.

It should be understood that the petroleum pitch/tar materials can include both natural and synthetic pitches and that such materials can be used as a component in the present invention. In certain aspects, the A-240 pitch, available from Marathon Ashland Petroleum L.L.C., is especially preferred as a starting component.

The pitch products produced by the method of the present invention have a desired low viscosity, a desired high coking value, and a desired high softening point. Further, the pitch product produced according to the method of the present invention surprisingly contains lower concentrations of polycyclic aromatic hydrocarbons below limits considered to be reportable per OSHA regulations (1910.1200). In certain embodiments, the total identified polycyclic aromatic hydrocarbons content is in the range of about 5000 mg/kg or less and in certain embodiments about 3000 mg/kg or less than other types of petroleum and coal tar pitches.

When making petroleum tar by formulating petroleum pitch with a cutback oil, the total amount of cutback oil needed to achieve the desired viscosity has a direct negative impact on the coking value of the petroleum tar product. Surprisingly, the properties of methyl esters of fatty acids such as biodiesel allow a petroleum tar to be produced with desired flow properties with lower concentrations of cutback oil. The resulting petroleum tar has a significantly higher coking value that a petroleum tar produced with standard, petroleum based cutback oils.

We discovered that it was possible to use at least one type of a biodiesel, a natural oil derived from vegetable oils or animal fats, as a coking value modifier for petroleum pitch/tar material. So far as is known, biodiesel has never been used as a coking value modifier before the present invention, though use of biodiesel as a release agent has been reported. For example, the following web site: http://www.soygold-.com/many_uses.htm teaches use of biodiesel as a release agent. Also, http://www.apexnorth.com/aplications/ teaches similar uses (e.g., asphalt release agent).

Biodiesels have been found to be useful as fuels because the biodiesels have a low vapor pressure, are non-toxic and are stable (as per HMIS regulation), and do not deteriorate or detonate upon mild heating.

Until the present invention, however, no-one had thought to use biodiesels as suitable as a component in making petroleum tars since such materials have high molecular weights and are highly aromatic. In contrast, biodiesel is aliphatic, has no sulfur, has low aromanticity, and has a relatively low molecular weight. Also, biodiesel contains large amounts of oxygen, often approaching 10%. While it could be argued that a linear, relatively low molecular weight, aliphatic molecule such as biodiesel would be a good release agent, it would not thought of as being considered suitable as a viscosity modifier of heavy, large hydrocarbons.

In spite of the teachings of the art, it was surprisingly found by the inventors herein that the aliphatic biodiesel materials work well as viscosity modifiers for petroleum pitch/tar materials.

Biodiesels are based on triglycerides, three fatty acids bound by glycerol. If the source is animal fat, e.g., tallow or lard or whale oil, the fatty acids are saturated; that is, they contain no double bonds. If the source is vegetable, the fatty acids are unsaturated; that is, they contain one or more double bonds. Some highly unconventional sources have also been studied, including over 20 years of work on making biodiesel from algae, as reported in Biodiesel from Algae, A look Back at the U.D. Department of Energy's Aquatic Species Program, which reported that the algae species studied in the program could produce up to 60% of their body weight in the form of triacylglycerols, the same natural oil made by oilseed crops. The complete report is expressly incorporated by reference and available at http://www.ott.doe.gov/biofuels/pdfs/biodiesel from algae ps.pdf.

For example, one preferred route for making biodiesel is to break the fatty acids free from the glycerol. Other methods of manufacturing biodiesel are found in U.S. Pat. No. 6,399,800; U.S. Pat. No. 6,348,074; U.S. Pat. No. 6,015,440; U.S. Pat. No. 6,203,585; U.S. Pat. No. 6,174,501; and U.S. Pat. No. 6,235,104, which are expressly incorporated by reference.

Useful "biodiesel" materials, as used herein, include mono alkyl esters of a long chain fatty acid derived from renewable lipid sources. Suitable sources include animal fats and vegetable oils, including, for example, soybean oil, sunflower oil, linseed oil, coconut oil, and the like.

Other useful biodiesel materials for use in the present invention comprise a mixture of fatty acid esters. Typically these materials are made by the transesterification of vegetable oil to biodiesel. One route to biodiesel involves reacting a vegetable oil (a trigylceride) with an alcohol, preferably methanol, to form biodiesel and glycerol. The biodiesel produced from vegetable oil may have the formula:

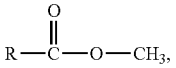

where R is typically 16-18 carbon atoms and may contain one or more C=C bonds.

It should be understood that the biodiesels can comprise methyl esters that contain, for example, $C_6$-$C_{14}$ fatty acids such as caproic, caprylic, capric, lauric, and myristic. The term "biodiesel" can also include, for example, methyl esters of $C_{12}$-$C_{22}$ fatty acids such as lauric acid, myristic acid, palmitic acid, palmitoleic acid, stearid acid, oleic acid, elaidic acid, petroselic acid, ricinoleic acid, elaeosteric acid, linoleic acid, linolenic acid, arachic acid, gadoleic acid, behenic acid and erucic acid. It should be understood however, that, in other embodiments, other useful biodiesel materials and mixtures of these and other biodiesels, are within the contemplated scope of the present invention.

In one aspect, the present invention relates to the use of varying concentrations of biodiesels to produce a significant increase in the coking value of petroleum pitch/tar materials. By blending the biodiesel with the coking values petroleum pitch/tar materials, such as A-500 petroleum pitch, are increased and there is a favorable impact on the viscosity of the final product. In one embodiment, blending about 36%, by wt., of biodiesel into A-500 pitch produces a petroleum pitch/tar material having a coking value of about 31.6%, which is about a 60% increase over the coking value of an A-500 pitch without any biodiesel added thereto.

Varying concentrations of biodiesels also causes significant changes in the viscosity of the petroleum pitch/tar materials. The viscosity reduction observed with biodiesel is significantly greater than that observed with A-240 pitch and A-500 pitch without any biodiesel. For example, the addition of about 36.5%, by wt., biodiesel in A-500 pitch produces a final product having a favorable low viscosity of about 246 centipoise at 160° F.

The use of biodiesels has little or no detrimental impact on other critical parameters of petroleum pitch/tar materials. Components detrimental to petroleum pitch/tar applications such as sulfur or ash are not present in biodiesel.

The biodiesel materials also provide the benefits of fire hazard safety and low toxicity during the preparation of the pitch materials. The biodiesel has no unpleasant odor, and although biodiesels will burn, the biodiesels have such a low volatility that the biodiesels will not form an explosive mixture in air under normal processing conditions. The biodiesels are essentially free of aromatics and considered non-toxic for skin contact and are readily biodegradable, should any spills occur.

According to another aspect of the present invention, the efficiency of biodiesel as a cutback oil to maintain a low viscosity of the petroleum tar allows such petroleum tar product to compete more favorably with coal tar certain markets. The use of biodiesel materials oxygenates, or modifies the pitch tar viscosity, which allows petroleum tar products to be made that better meet many customer requirements. These product have the desired coking value (comparable to coal tar based products) with lower concentrations of polycyclic aromatic hydrocarbons specifically those regulated by OSHA regulations (1910.1200).

The present invention also provides for an improved end product. Specifically, in the applications where the biodiesel materials are used with petroleum tar, an increased coking value is achieved while still maintaining a desired viscosity as compared to standard petroleum tars. This petroleum tar material is especially useful in applications which had not previously been found suitable for neat petroleum tar (without the biodiesel viscosity modification of the present invention).

The following examples are intended only to further illustrate the invention and are not intended to limit the scope of the invention as defined by the claims.

EXAMPLE

A-240 pitch is a highly aromatic, low ash, petroleum resin type product produced at the Marathon Ashland Petroleum LLC Catlettsburg, Ky. refining complex. Biodiesel produced by the methyl esterification of animal derived fatty acids was obtained from Griffin Industries in Cold Springs, Ky. Blend composition and a comparison of the properties of the A-500 type petroleum tar versus the petroleum pitch/tar material using biodiesel as a cutback oil are shown in Table II.

TABLE II

Analysis of Petroleum Tar for Refractory Industry

| Compound ID | Petroleum Tar Produced Using Typical Hydrocarbon Cutback Oil | Petroleum Tar Produced Using Biodiesel Cutback Oil |
|---|---|---|
| Properties | | |
| Coking Value, wt%, ASTM D 241B | 19 | 31.6 |
| Viscosity, absolute @ 160° F., centipoise | 230 to 300 | 246 |

Overall, the industry is concerned with the polycyclic aromatic hydrocarbon content of petroleum tar and coal tar type pitches and tars. Some groups, such as the United States Environmental Protection Agency, regulate emissions of certain polycyclic aromatic hydrocarbons. Another group, the American Petroleum Institute, evaluates polycyclic aromatic hydrocarbons in petroleum products using a set of compounds known as persistent bioccumulative toxins (PBTs). As shown in Table III, the present invention product contains a significantly lower polycyclic aromatic hydrocarbon content, regardless of the method of evaluation.

TABLE III

Summary of Polycyclic Aromatic Hydrocarbon Content of Petroleum Tars

| | Typical Petroleum Tar | Petroleum Tar formulated with Biodiesel |
|---|---|---|
| Polycyclic Aromatic Hydrocarbons regulated by US EPA | 11,920 | 3,080 |
| Total PBTs | 16,050 | 4,020 |
| Total Detected Polycyclic Hydrocarbons | 21,060 | 4,540 |

Regardless of the type of method used to summarize sample data, use of the petroleum pitch/tar material provides a significant reduction in the polycyclic aromatic hydrocarbon content compared to the typical petroleum tar product being sold commercially as of this date.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method of maintaining a desired viscosity with reduced impact on the coking value of a resulting petroleum tar comprising dissolving at least one petroleum pitch starting material into at least one biodiesel material.

2. The method of claim 1, in which the at least one petroleum pitch starting material is substantially molten.

3. The method of claim 1, in which the at least one petroleum pitch starting material is substantially solid.

4. The method according to claim 1, wherein the petroleum pitch starting material has a coking value of about 35 wt % or greater.

5. The method of claim 1, wherein from about 20 to about 45 wt % of the at least one biodiesel is dissolved in the petroleum pitch starting material.

6. The method of claim 1, wherein about 35 to about 40 wt % the at least one biodiesel is dissolved in the petroleum pitch starting material.

7. The method of claim 1, wherein the petroleum pitch starting material further comprises petroleum pitch and at least one petroleum based cutback oil.

8. The material of claim 1, wherein the petroleum pitch starting material comprises about 35%, by wt., petroleum pitch and about 65%, by wt., #6 fuel oil.

9. The method of claim 1, wherein the biodiesel material comprises at least one oxygenate compound.

10. The method of claim 1, wherein the biodiesel material comprises at least one type of ester derived from vegetable oils and/or animal fats.

11. The method of claim 1, wherein the biodiesel material comprises suitable fatty acid esters.

12. The method of claim 9, wherein the biodiesel material comprises suitable fatty acid methyl esters.

* * * * *